United States Patent [19]

Troiano et al.

[11] Patent Number: 4,905,855

[45] Date of Patent: Mar. 6, 1990

[54] PROPANE CARRY SAFE

[76] Inventors: Joseph M. Troiano, 150 Overlook Ave. 7G, Peekskill, N.Y. 10566; George Spector, 233 Broadway, Rm. 3815, New York, N.Y. 10007

[21] Appl. No.: 216,502

[22] Filed: Jul. 8, 1988

[51] Int. Cl.[4] ..... B65D 6/02

[52] U.S. Cl. ..... 220/3; 220/408; 220/85 P; 220/94 A; 220/94 B; 206/0.6

[58] Field of Search ..... 206/0.6; 220/30, 408, 220/212, 85 P, 94 A, 946, 328; 137/382

[56] References Cited

U.S. PATENT DOCUMENTS

| | | | |
|---|---|---|---|
| 1,063,503 | 6/1913 | Buckley | 220/408 |
| 1,986,145 | 1/1935 | Goodyear | 220/408 |
| 2,020,179 | 11/1935 | Hallowell | 220/94 A |
| 2,182,116 | 12/1939 | Copeman | 220/408 |
| 3,246,825 | 4/1966 | Zastrow | 220/408 |
| 3,323,541 | 6/1967 | Schneider et al. | 220/85 P |
| 3,550,412 | 12/1970 | Pitel et al. | 70/208 |
| 3,921,872 | 11/1975 | Buell, Jr. | 206/446 |
| 4,103,806 | 8/1978 | White | 220/85 P |
| 4,167,104 | 9/1979 | Bond | 70/208 |
| 4,294,481 | 10/1981 | Pearl | 294/146 |
| 4,624,495 | 11/1986 | Marsh | 292/31.2 |
| 4,802,515 | 2/1989 | Pytryga et al. | 220/3 |

*Primary Examiner*—Henry J. Recla
*Assistant Examiner*—Edward C. Donovan

[57] ABSTRACT

A propane tank safety carrier is provided and consists of a box-like housing with a hinged cover that will snuggly hold the propane tank in an upright protective position during transportation.

4 Claims, 1 Drawing Sheet

PROPANE CARRY SAFE

BACKGROUND OF THE INVENTION

The instant invention relates generally to gas cylinder carriers and more specifically it relates to a propane tank safety carrier.

Numerous gas cylinder carriers have been provided in prior art that are adapted to protect gas cylinders during handling and transportation thereof. For example, U.S. pat. nos. 3,921,872; 4,294,481 and 4,624,495 all are illustrative of such prior art. While these units may be suitable for the particular purpose to which they address, they would not be as suitable for the purposes of the present invention as heretofore described.

SUMMARY OF THE INVENTION

A primary object of the present invention is to provide a propane tank safety carrier that will overcome the shortcomings of the prior art devices.

Another object is to provide a propane tank safety carrier that will snugly hold a twenty pound propane tank in an upright protective position during transportation from a home to a propane filling station and back again.

An additional object is to provide a propane tank safety carrier that includes a recessed carry handle built into sides of the housing that engages the valve protector and tank handle so that a person can carry the complete unit during transportation thereof.

A further object is to provide a propane tank safety carrier that is simple and easy to use.

A still further object is to provide a propane tank safety carrier that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
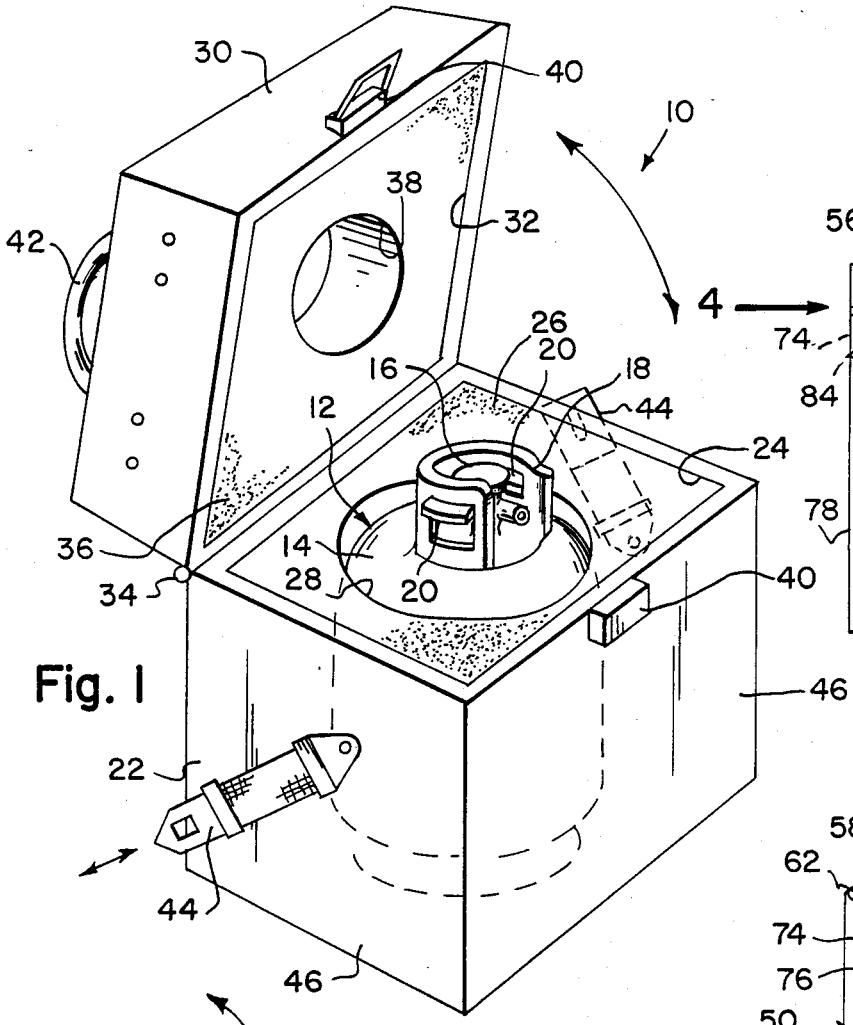
FIG. 1 is a perspective view of the invention.
Figure 2:
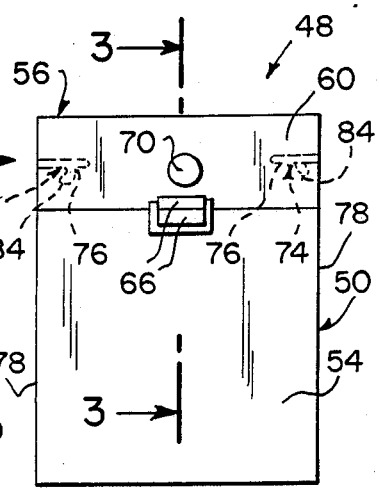
FIG. 2 is a front view of a modification.
Figure 4:
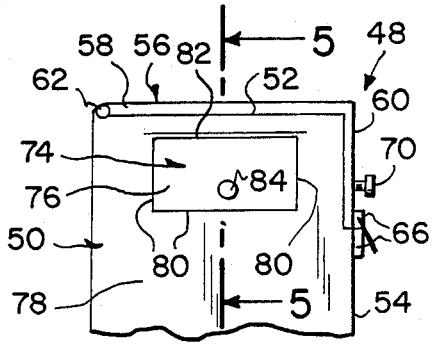
FIG. 4 is a side view with parts broken away as indicated by arrow 4 in FIG. 2 showing one of the housing carry handles in a down position in the housing.
Figure 3:
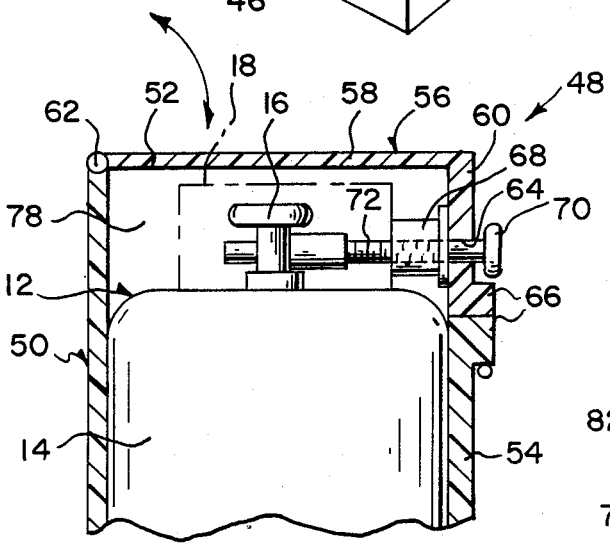
FIG. 3 is an enlarged cross sectional view taken along line 3—3 in FIG. 2 showing the plug locking the cover to the propane tank.
Figure 5:
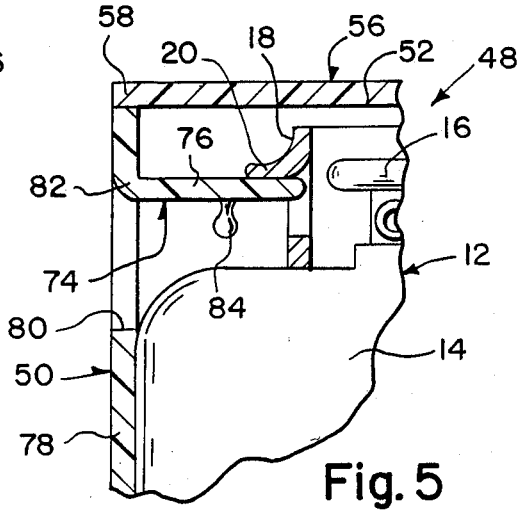
FIG. 5 is an enlarged cross sectional view taken along line 5—5 in FIG. 4 with parts broken away showing the carry handle in an up position in greater detail.

Turning now descriptively to the drawings, in which similar reference characters denote similar elements throughout the several views, FIG. 1 illustrates a safety carrier 10 for a propane tank 12 that has a cylindrical body 14, a valve assembly 16 and a valve protector 18 with tank carry handles 20 at a top end of the cylindrical body 14. The carrier 10 consists of a box-like housing 22 that has an open top 24. A first foam packing insert 26 that has a first central cylindrical aperture 28 therein is sized to fit into the open top 24 of the housing 22 so that the first aperture 28 will receive the cylindrical body 14.

A box-like cover 30 that has an open bottom 32 is provided and is hinged at 34 at one side to top of the housing 22. A second foam packing insert 36 that has a second central cylindrical aperture 38 therein is sized to fit into the open bottom 32 of the cover 30 so that the second aperture 38 will receive the valve assembly 16 and the valve protector 18 with tank carry handles 20 when the cover 30 is in a closed position.

A latch mechanism 40 is connected between the housing 22 and the cover 30 opposite the hinge 34 for locking the cover 30 to the housing 22 when the cover is in the closed position so that the propane tank 12 will be snuggly holed in an upright protective position during transportation. A handle 42 is affixed to top of the cover 30 enabling a person (not shown) to grip the handle 42 when the cover 30 is in a locked closed position so as to easily transport the carrier 10 from one place to another. A set of securement straps 44 are also provided. Each strap 44 is affixed to an opposite side 46 of the housing 22 to lock into seat belts in a motor vehicle (not shown) so that the carrier 10 can be transported on a seat in the motor vehicle.

FIGS. 2 through 5 shows a modified safety carrier 48 for the propane tank 12. The carrier 48 consists of a box-like housing 50 that has an open top 52 and a partially open front wall 54 sized to receive the cylindrical body 14. An L-shaped cover 56 that has long arm 58 and a short arm 60 is hinged at 62 at end of the long arm 58 and a short arm 60 is hinged at 62 at end of the long arm 58 to top of the housing 50. A cover 56 will enclose the valve assembly 16 and the valve protector 18 with tank carry handles 20 in the carrier 48 when the cover 56 is in a closed position. The short arm 60 has an aperture 64 therethrough.

A latch mechanism 66 is connected between the housing 50 and the cover 56 opposite the hinge 62 for locking the cover 56 to the housing 50 when the cover is in the closed position. A threaded sleeve 68 is affixed to inner surface of the short arm 60 of the cover 56 behind the aperture 64 so as to be in proper alignment with the valve assembly 16 when the cover 56 is in the closed position. A plug 70 that has a threaded shaft 72 extends past the aperture 64 and threads into the threaded sleeve 68 and the valve assembly 16 when the cover 56 is in the closed position, so as to lock the cover to the propane tank 12.

The modified safety carrier 48 further contains a pair of housing carry handles 74. Each of the housing carry handles 24 is shaped into a plate 76 and formed from an opposite side 78 of the housing 50 by being cut out on three edges 80 with top fourth edge being a hinge 82 on the housing 50 so that the plate 76 can be folded inwardly to engage with one of the tank carry handles 20 on the valve protector 18, enabling a person (not shown) to grip both of the housing carry handles 74 when the cover 56 is in the locked closed position so as to easily transport the carrier 48 from one place to another. A pair of pull knobs 84 are also provided. Each of the pull knobs 84 are affixed to one of the plates 76 so that each of the housing carry handles 74 can be pulled back to a vertical position with respect to the side 54 of the housing 50 allowing the propane tank 12 to be removed therefrom.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A safety carrier for a propane tank having a cylindrical body, a valve assembly and a valve protector with tank carry handle at a top end of the cylindrical body said carrier comprising:

(a) a box like housing having an open top and a partially open front wall sized to receive the cylindrical body;

(b) an L-shaped cover having a long arm and a short arm being hinged at end of said long arm to top of said housing so that said cover will enclose the valve assembly and the valve protector with tank carrying handles in said carrier when said cover is in a closed position, said short arm having an aperture therethrough;

(c) means for locking said cover to said housing when said cover is in the closed position;

(d) a threaded sleeve affixed to an inner surface of said short arm of said cover behind said aperture so as to be in proper alignment with the valve assembly when said cover is in the closed position; and (e) a plug having a threaded shaft to extend past said aperture and threads into said threaded sleeve and the valve assembly when said cover is in the closed position so as to lock said cover to the propane tank, wherein said locking means is a latch mechanism connected between said housing and said cover opposite said hinged side thereof.

2. A safety carrier as received in claim 1, further comprising:

(f) a pair of housing carry handles, each of said housing carry handles is shaped into a plate and formed from an opposite side of said housing by being cut out on three edges with top fourth edge being a hinged on said housing so that said plate cam be folded inwardly to engage with one of the tank carry handles of the valve protector, enabling a person to grip both of said housing carry handles when said cover is in the locked closed position so as to easily transport said carrier from one place to another; and (g) a pair of pull knobs, each of said pull knobs affixed to one of said plates so that each of said housing carry handles can be pulled back to a vertical position with respect to said side of said housing allowing the propane tank to be removed therefrom.

3. A safety carrier for a propane tank having a cylindrical body, a valve assembly and a valve protector with tank carry handle at a top end of the cylindrical body, said carrier comprising:

(a) a box-like housing having an open top and a partially open front wall sized to receive the cylindrical body;

(b) an L-shaped cover having a long arm and a short arm being hinged at end of said long arm top to of said housing so that said cover will enclose the valve assembly and the valve protector with tank carry handles in said carrier when said cover is in a closed position, said short arm having an aperture therethrough;

(c) means for locking said cover to said housing when said cover is in the closed position.

(d) a threaded sleeve affixed to an inner surface of said short arm of said cover behind said aperture so as to be in proper alignment with the valve assembly when said cover is in the closed position; and (e) a plug having a threaded shaft to extend past said aperture and threads into said threaded sleeve and the valve assembly when said cover is in the closed position so as to lock said cover to the propane tank, said shaft adapt to coact with said valve protector whereby opening movement of said cover is prevented by engagement of said shaft with said protector.

4. A safety carrier as in claim 3 in combination with carrying means on said cover movable inwardly to engage said protector for carrying purposes.

* * * * *